US007658186B2

(12) United States Patent
Yeh

(10) Patent No.: US 7,658,186 B2
(45) Date of Patent: Feb. 9, 2010

(54) MULTI-PURPOSES MECHANISM FOR SHOOTING APPARATUS

(75) Inventor: Hsin-Cheng Yeh, Yung Kang (TW)

(73) Assignee: Sunworld Industrial Co., Ltd., Tainan Hsien (TW)

( * ) Notice: Subject to any disclaimer, the term of this patent is extended or adjusted under 35 U.S.C. 154(b) by 2 days.

(21) Appl. No.: 12/068,374

(22) Filed: Feb. 6, 2008

(65) Prior Publication Data

US 2009/0133681 A1 May 28, 2009

(30) Foreign Application Priority Data

Nov. 26, 2007 (TW) ..... 96219952 U

(51) Int. Cl.
*F41B 11/00* (2006.01)

(52) U.S. Cl. ..... 124/73; 124/74; 124/75; 124/76; 124/77; 42/76.01; 42/77; 42/79

(58) Field of Classification Search ..... 124/73–77; 42/76.01, 77, 79
See application file for complete search history.

(56) References Cited

U.S. PATENT DOCUMENTS 5,706,599 A * 1/1998 Knight ..... 42/75.02
5,769,066 A * 6/1998 Schneider ..... 124/75
6,112,447 A * 9/2000 Androsov ..... 42/79
6,698,128 B2 * 3/2004 Kessler ..... 42/76.01
7,500,478 B2 * 3/2009 Yeh ..... 124/73
2004/0089280 A1 * 5/2004 Kunimoto ..... 124/76
2005/0091901 A1 * 5/2005 Perry et al. ..... 42/78
2008/0168973 A1 * 7/2008 Levin et al. ..... 124/73
2008/0173166 A1 * 7/2008 Andry ..... 89/14.3
2009/0013984 A1 * 1/2009 Spets ..... 124/73

* cited by examiner

*Primary Examiner*—Troy Chambers
*Assistant Examiner*—Samir Abdosh
(74) *Attorney, Agent, or Firm*—Rosenberg Klein & Lee

(57) ABSTRACT

A multi-purposes mechanism for shooting apparatus includes a gun body, a barrel, a shooting member, and a rear cap. The gun body comprises a hollow tube perpendicularly interconnecting with a first loading hole at a center portion of the hollow tube. A first stage is formed on an inner wall of the tube in front of the first loading hole. A second stage is formed on the inner wall of the tube in back of the first loading hole. The barrel is disposed in the tube before the first loading hole, and has a first engaging ring corresponding to the first stage of the tube. The shooting member is disposed in the tube after the first loading hole, and has a second engaging ring on an outer wall thereof corresponding to the second stage of the tube. The rear cap is connected to a rear end of the tube.

2 Claims, 8 Drawing Sheets

MULTI-PURPOSES MECHANISM FOR SHOOTING APPARATUS

BACKGROUND OF THE INVENTION

1. Field of the Invention

The present invention relates to a multi-purposes mechanism for shooting apparatus, and more particularly to a shooting apparatus which is capable of shooting either BB ball and paintball by exchange a barrel and a shooting member.

2. Description of the Prior Art

A conventional paintball gun uses pressurized air to shoot bullets, and a conventional BB gun is mostly using elastic mechanism to shoot bullets, although pressurized air can provide a better effect of shooting, however the bullets for BB gun are different from the bullets for paintball gun, thus users need to purchase two different guns for shooting fun.

SUMMARY OF THE INVENTION

The present invention provides a multi-purposes mechanism for shooting apparatus to exchange a barrel and a shooting member so as to be capable of shooting BB bullets and paintball bullets with the apparatus.

According to the present invention, there is provided a multi-purposes mechanism for shooting apparatus comprising a gun body, a barrel, a shooting member, and a rear cap, said gun body comprising a hollow tube perpendicularly interconnecting with a first loading hole at a center portion of said hollow tube, a first stage being formed on an inner wall of said tube in front of said first loading hole, a second stage being formed on the inner wall of said tube in back of said first loading hole, said barrel being disposed in a front portion of said tube before said first loading hole, said barrel having a first engaging ring corresponding to said first stage of said tube, said shooting member being disposed in a rear portion of said tube after said first loading hole and having a second engaging ring on an outer wall thereof corresponding to said second stage of said tube, said rear cap being connected to a rear end of said tube.

Preferably, said first engaging ring of said barrel is formed on a rear edge of said barrel, and a front portion of said shooting member has an outer diameter corresponding to an inner diameter of said barrel.

Alternatively, said first engaging ring of said barrel is formed on a rear outer wall of said barrel, said barrel further having a second loading hole at a rear end thereof, a front portion of said shooting member having an outer diameter corresponding to an inner diameter of said barrel to extend into said barrel.

It is the primary object of the present invention to provide a multi-purposes mechanism for shooting apparatus, which provides a barrel and a shooting member changeable for different purposes.

It is another object of the present invention to provide a multi-purposes mechanism for shooting apparatus, which allows a user to choose either one or multiple sets and is able to assemble by themselves.

It is still another object of the present invention to provide a multi-purposes mechanism for shooting apparatus, which allows the user to disengage the barrel by hand, to disengage the rear cap with a hand tool, and to replace the shooting member by hand.

It is a further object of the present invention to provide a multi-purposes mechanism for shooting apparatus, which minimizes the cost of production.

It is still a further object of the present invention to provide a multi-purposes mechanism for shooting apparatus, which shortens the shooting interval of BB bullets and decreases the friction, thus the user may experience a fast shooting fun.

BRIEF DESCRIPTION OF THE PREFERRED EMBODIMENT

Figure 1:
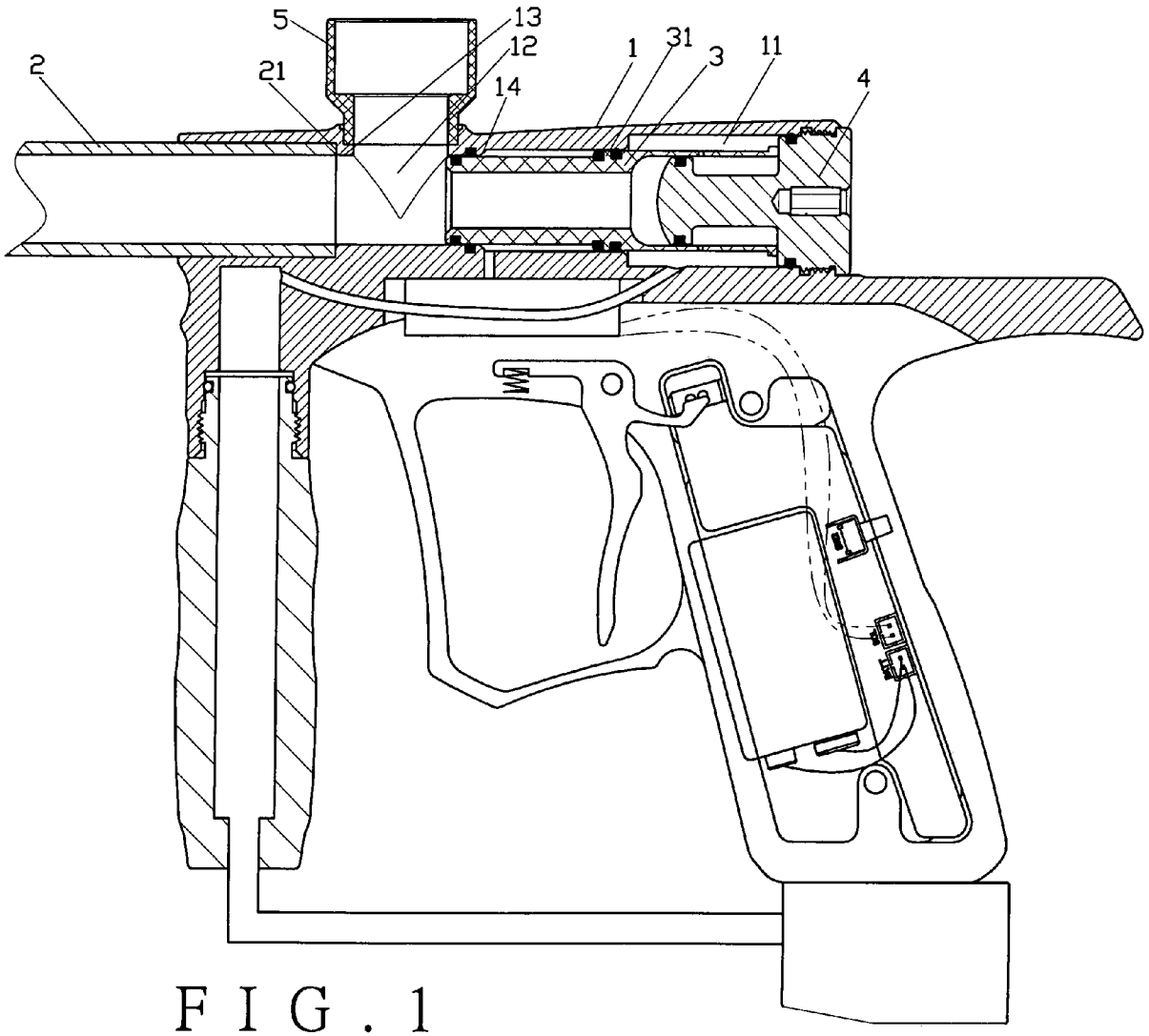
FIG. 1 is a cross-sectional view of the present invention (a paintball gun is demonstrated)

As shown in FIG. 1, a preferred embodiment of the present invention comprises a gun body 1, a barrel 2, a shooting member 3, and a rear cap 4.

The gun body 1 comprises a hollow tube 11 perpendicularly interconnecting with a first loading hole 12 provided at a center portion of the tube 11. The first loading hole 12 is connected with a loader 5 for paintball bullets. The inner wall of the tube 11 is formed with a first stage 13 in front of the first loading hole 12 and a second stage 14 in back of the first loading hole 12. The barrel 2 is disposed in a front portion of the tube 11 before the first loading hole 12, and has a first engaging ring 21 corresponding to the first stage 13. The shooting member 3 is disposed in a rear portion of the tube 11 after the first loading hole 12, and has a second engaging ring 31 on an outer wall of the shooting member 3 to engage with the second stage 14. The rear cap 4 is secured to the rear end of the tube 11. As shown in FIG. 1, the first engaging ring 21 is a rear edge of the barrel 2. The front portion of the shooting member 3 has an outer diameter corresponding to an inner diameter of the barrel 2. As shown in FIG. 1, the present invention is applied to a paintball gun.

Figure 2:
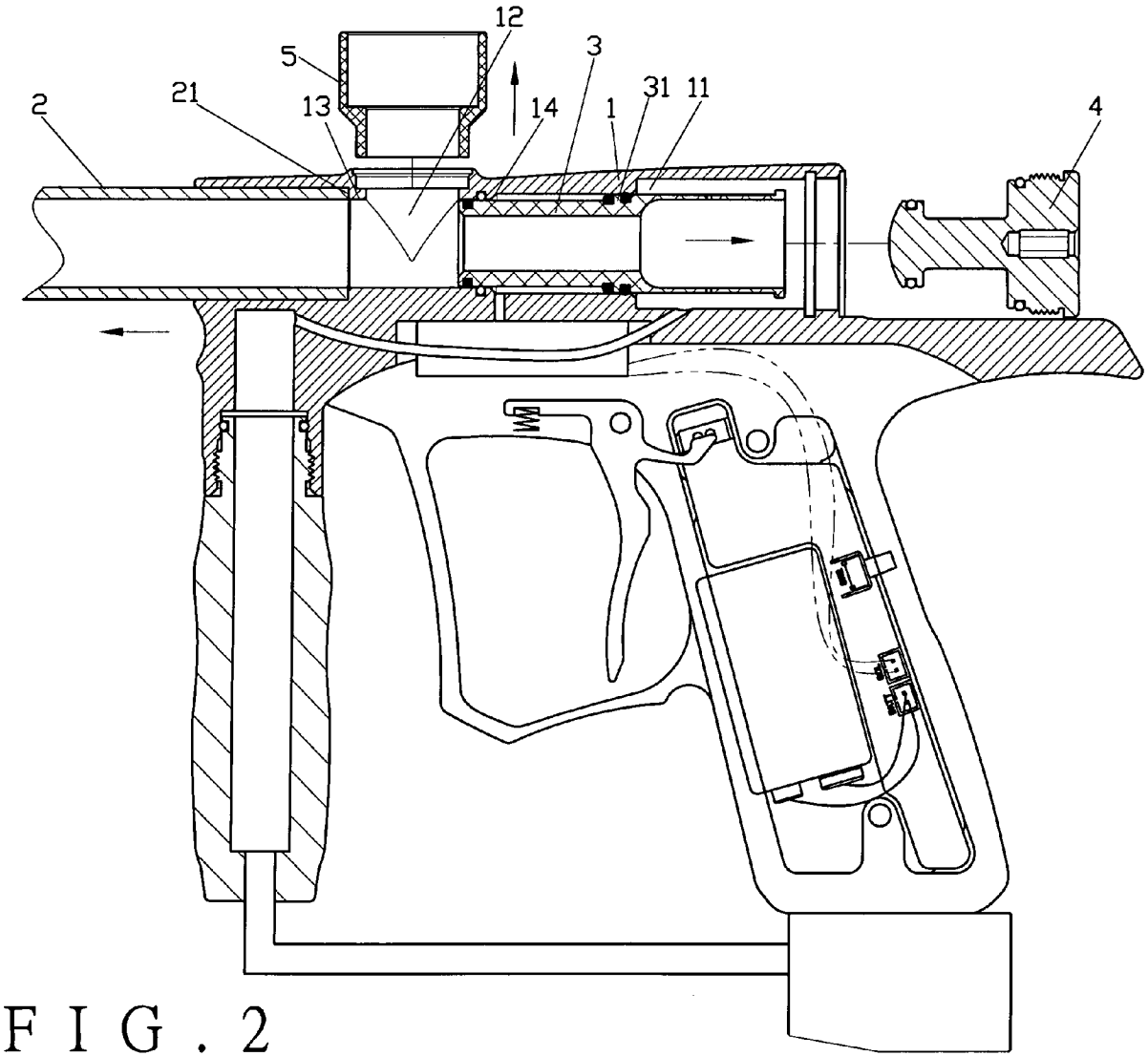
FIG. 2 is a cross-sectional view of the present invention in a dismantled status.
Figure 3:
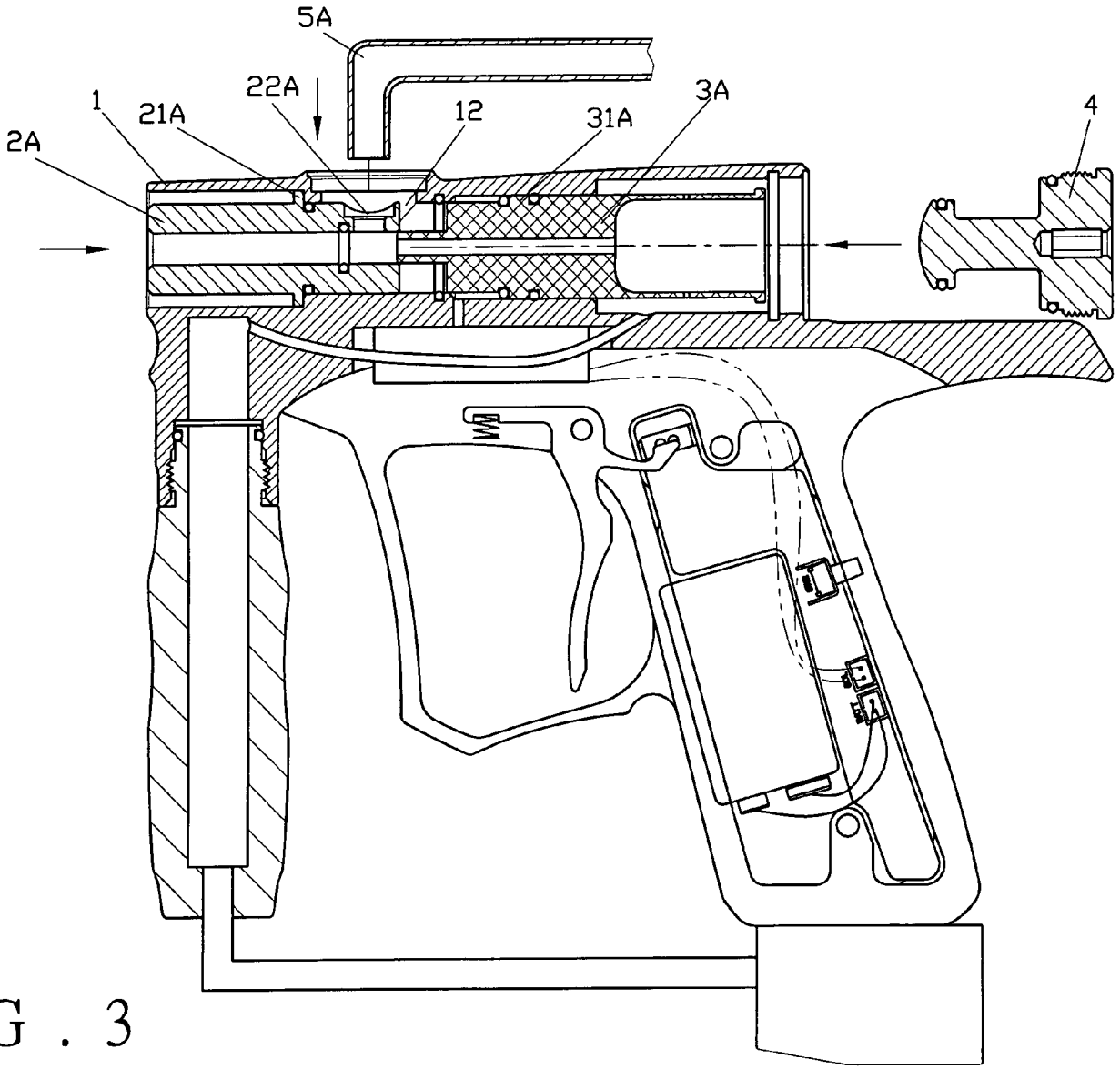
FIG. 3 is a cross-sectional view of the present invention showing an exchange of the paintball gun into a BB gun.
Figure 4:
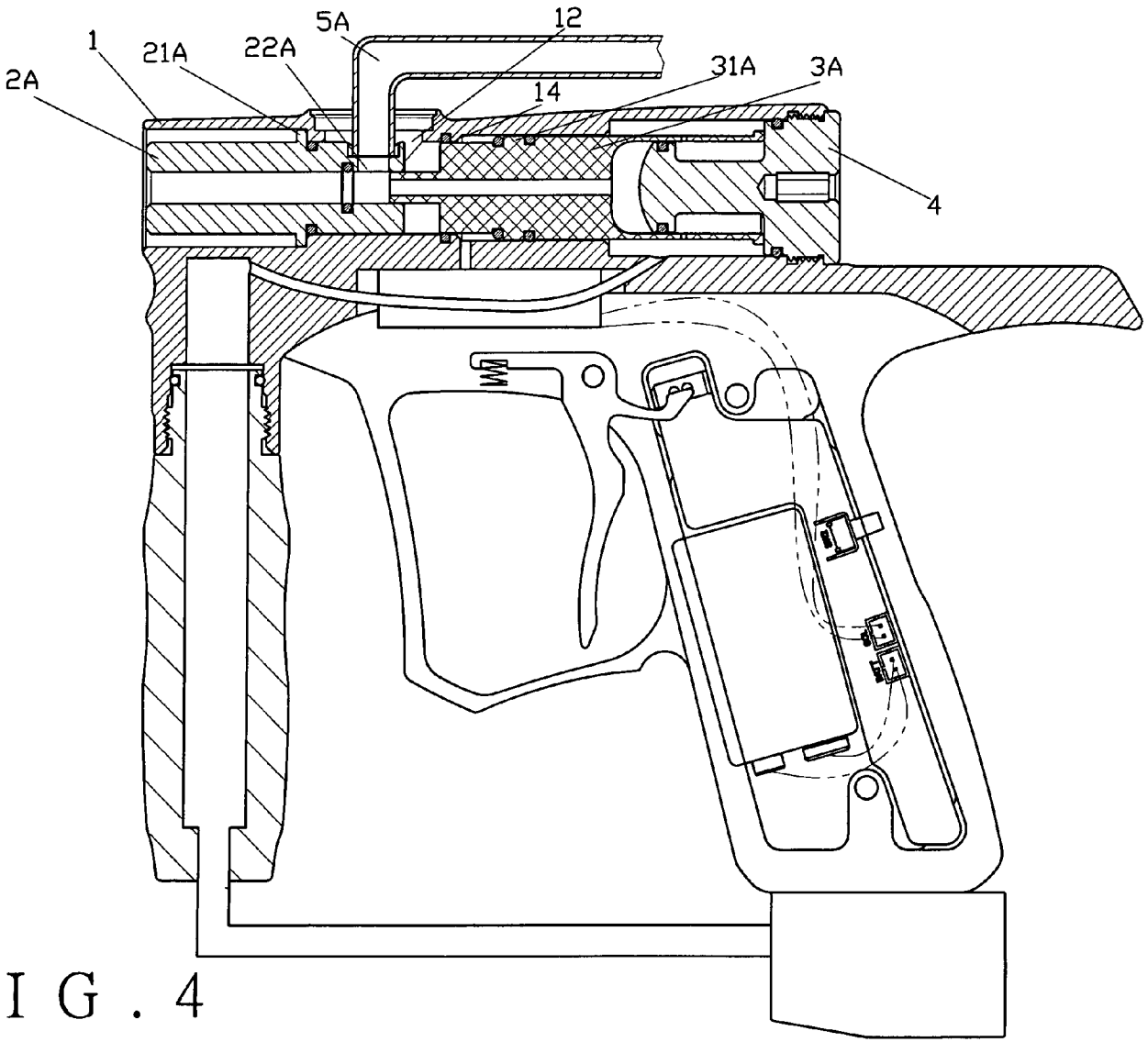
FIG. 4 is a cross-sectional view of a BB gun of the present invention, wherein the barrel and the shooting member are for BB gun shooting.

When it is desired to exchange the paintball gun into a BB gun, as shown in FIG. 2, the barrel 2 and the loader 5 are detached from the gun body 1 by hand first, and the rear cap 4 is unscrewed from the gun body 1 by means of a hand tool to detach the shooting member 3. As shown in FIG. 3, after replacing with a shooting member 3A for BB gun bullets, the rear cap 4 is screwed back to the gun body 1, and then a barrel 2A and a loader 5A for BB gun are mounted to the gun body 1 by hand. The gun body 1 and the rear cap 4 are made in common design that can be used at both guns. The barrel 2A is disposed in the front portion of the tube 11 before the first loading hole 12. The barrel 2A has a first engaging ring 21A on the rear outer end of the barrel 2A. The rear end of the barrel 2A is formed with a second loading hole 22A interconnecting with the barrel 2A for connection of the loader 5A, as shown in FIG. 4. The shooting member 3A is located inside the tube 11 behind the first loading hole 12. The shooting member 3A has a second stage 31A on the outer wall corresponding to the second engaging ring 14. The front portion of the shooting member 3A has an outer diameter corresponding to the inner diameter of the tube 2A so that it may be inserted in the tube 2A.

Figure 5:
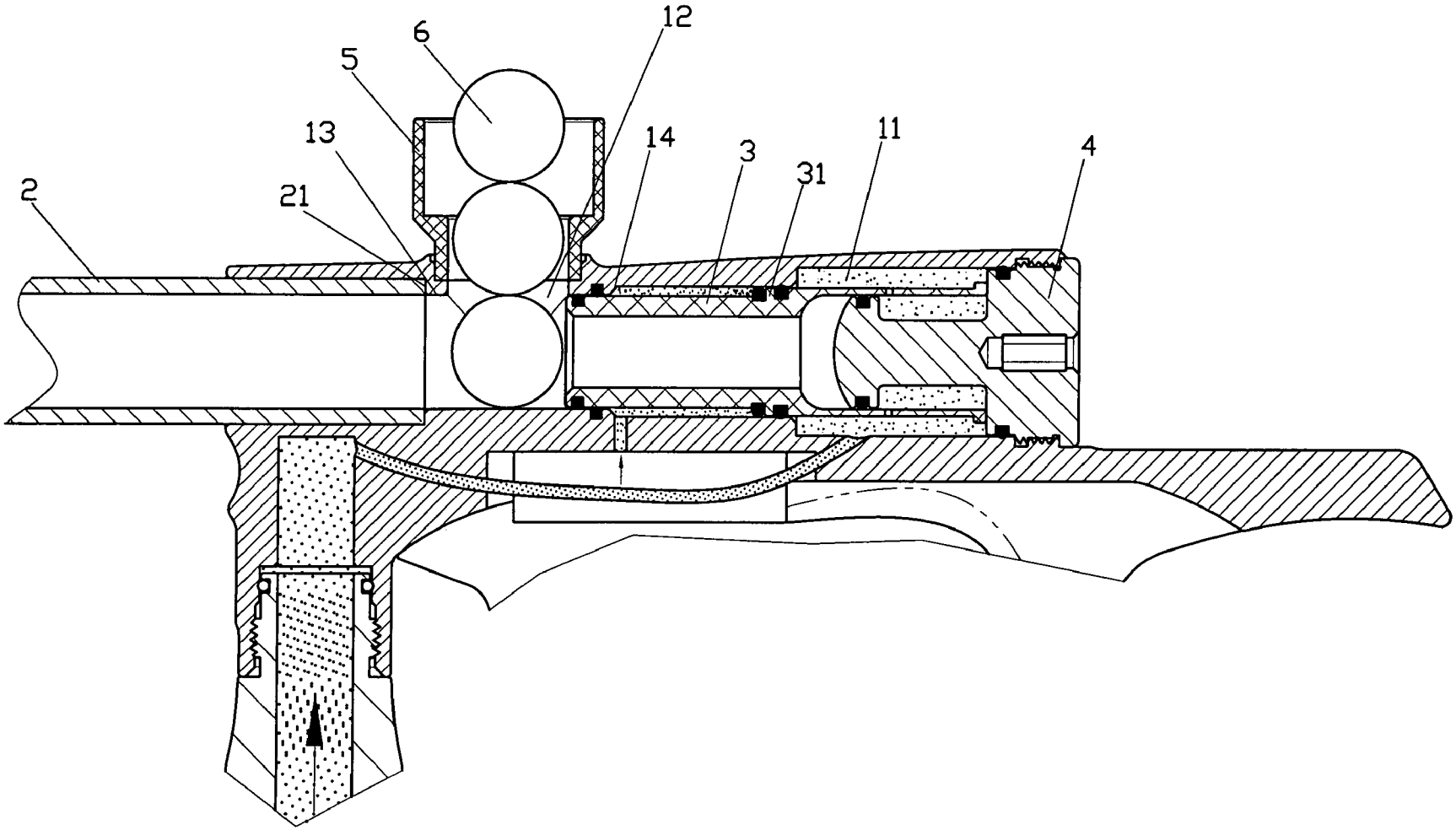
FIG. 5 is a cross-sectional view showing that a paintball bullet is ready to be shot.
Figure 6:
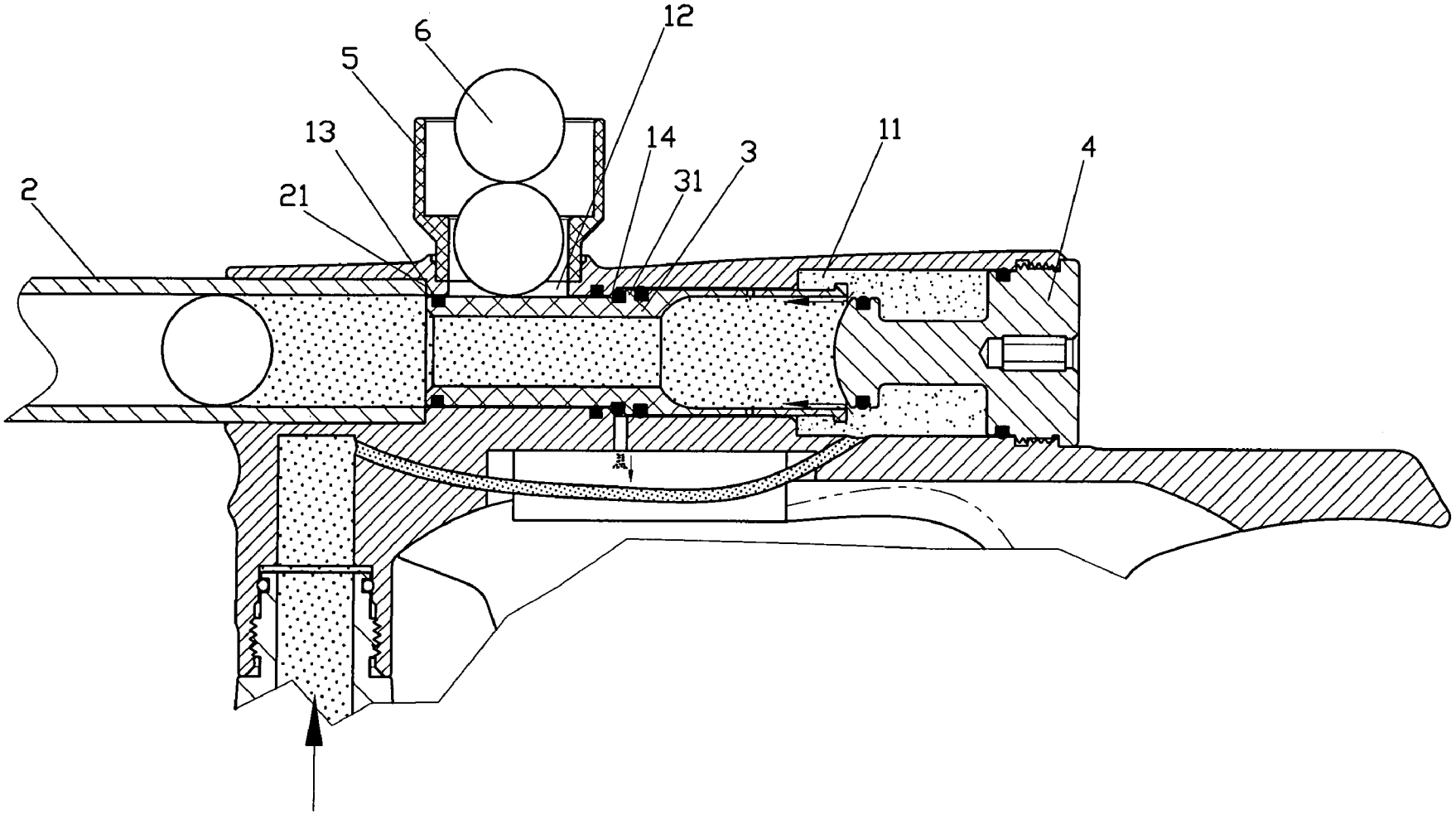
FIG. 6 is a view similar to FIG. 5 with the paintball bullet being shot.

To operate the present invention as a paintball gun, as shown in FIG. 5, the shooting member 3 urged by pressurized air is pushed to force a paintball bullet 6 into the tube 2. As shown in FIG. 6, the pressurized air in the shooting member 3 pushes the bullet 6, without doing any pushing against the barrel 2 and the loader 5. The barrel 2 and the loader 5 are tightened by hand only without any hand tools.

Figure 7:
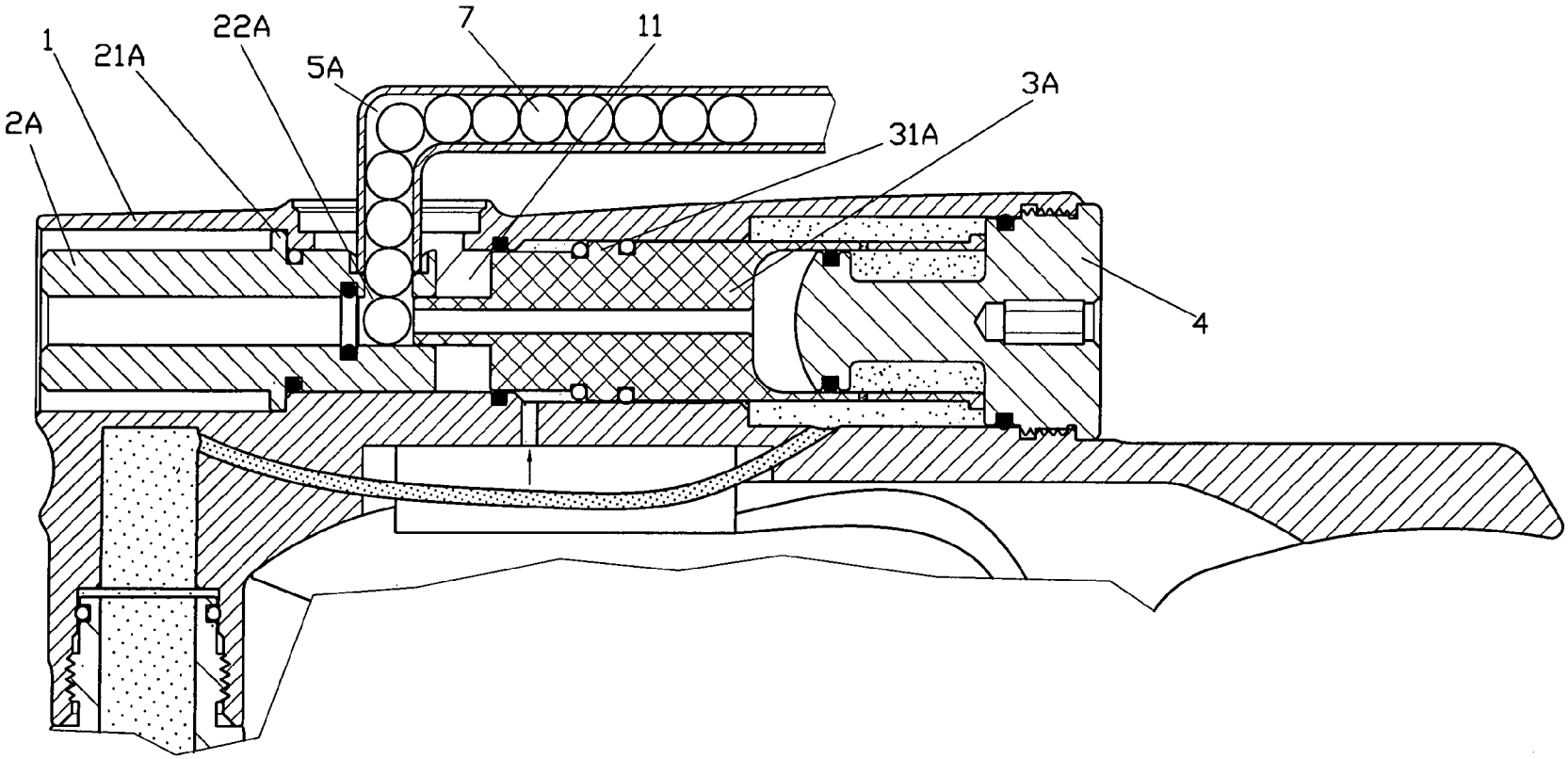
FIG. 7 is a cross-sectional view showing a BB gun bullet is ready to be shot.
Figure 8:
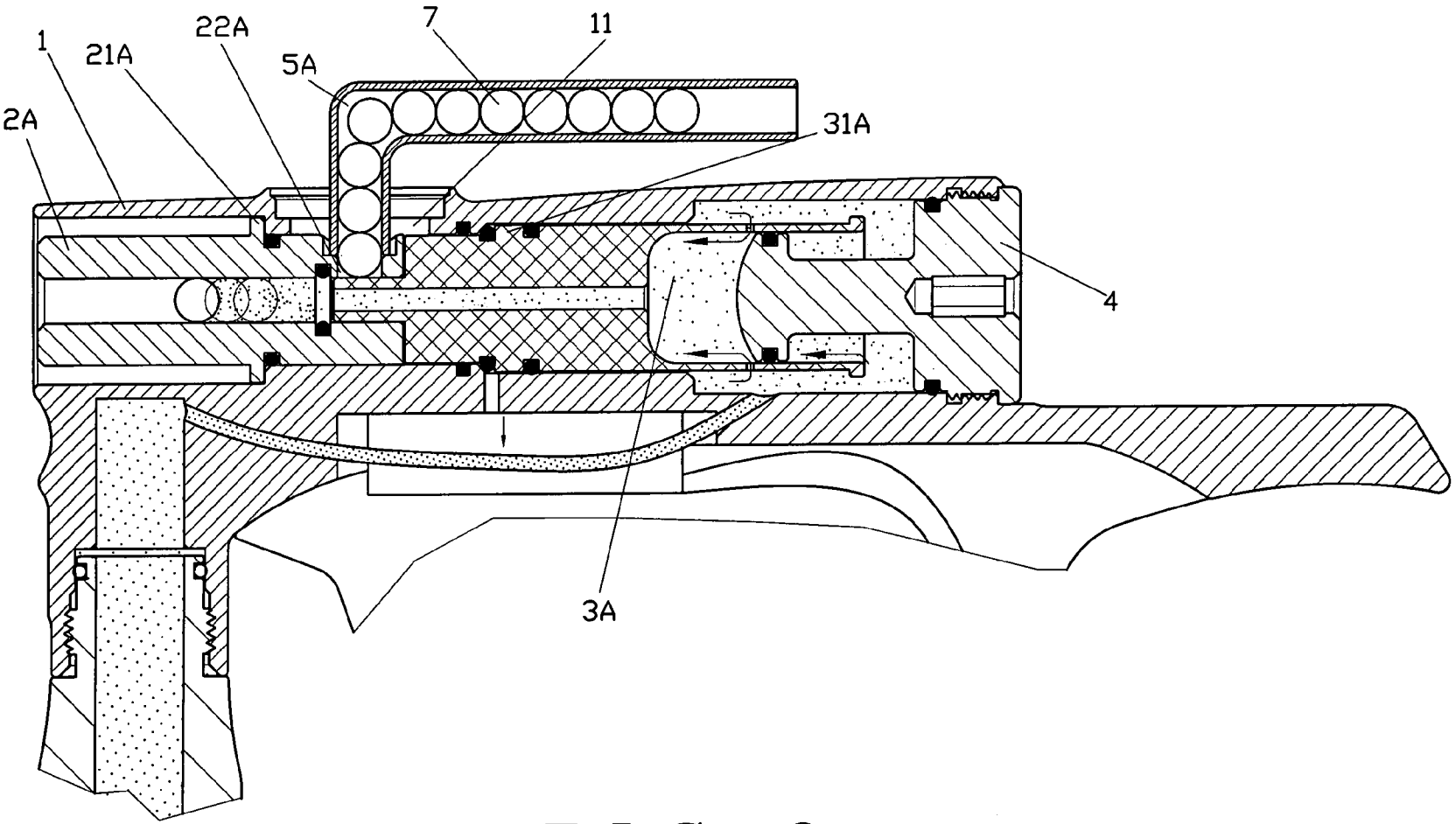
FIG. 8 is a view similar to FIG. 7 with the BB gun bullet being shot.

To operate the present invention as a BB gun, as shown in FIG. 7, BB bullets 7 are loaded in the second loading hole 22A of the barrel 2A through the loader 5A. The shooting member 3A is urged by the pressurized air to extend into the tube 2A and push the BB bullets 7. As shown in FIG. 8, the shooting member 3A reaches to and passes through the second loading hole 22A of the barrel 2A to shoot the BB bullets 7. The pressurized air acts only to push the BB bullets 7, it does not affect either the barrel 2A or the loader 5A. Thus, the barrel 2A and the loader 5A may be tightened by hand only without any hand tools.

What is claimed is:

1. A multi-purpose mechanism for a shooting apparatus, comprising:

a gun body having a hollow tube extending longitudinally therethrough and a first loading hole transverse intersecting said tube, said tube having a first stage formed on an inner wall thereof distal of said first loading hole and a second stage formed on the inner wall of said tube proximal of said first loading hole;

a rear cap releasably coupled to a proximal end of said tube;

a pair of barrels interchangeably mountable to said gun body, a first of said pair of gun barrels being adapted for use with paint balls and being removably disposed in a distal portion of said tube to abut said first stage, a second of said pair of gun barrels being adapted for use with BB shot and being removably disposed in said distal portion of said tube and extending to a position intermediate said first and second stages, said second barrel having a second loading hole disposed in open communication with said first loading hole; and a pair of shooting members interchangeably mountable within a proximal portion of said tube and being received by said second stage of said tube, a first of said pair of shooting members having a distal end with an outer diameter corresponding to an inner diameter of said first gun barrel and being disposed distally of said first loading hole, a second of said pair of shooting members having a distal end with an outer diameter corresponding to an inner diameter of said second gun barrel and being received therein.

2. The multi-purpose mechanism for a shooting apparatus as defined in claim 1, further comprising a pair of interchangeably mountable loaders, a first of said pair of loaders being a paint ball loader releasably connectable to said first loading hole, a second of said pair of loaders being a BB shot loader passing through said first loading hole and being releasably connectable to said second loading hole.

* * * * *